US010765154B2

(12) United States Patent
Mitsui et al.

(10) Patent No.: US 10,765,154 B2
(45) Date of Patent: Sep. 8, 2020

(54) UPPER WEAR

(71) Applicant: Fast Retailing Co., Ltd., Yamaguchi-shi, Yamaguchi (JP)

(72) Inventors: Yusuke Mitsui, Yamaguchi (JP); Satoyo Yamaguchi, Yamaguchi (JP); Weiyi Xia, Yamaguchi (JP)

(73) Assignee: Fast Retailing Co., Ltd., Yamaguchi-Shi (JP)

( * ) Notice: Subject to any disclaimer, the term of this patent is extended or adjusted under 35 U.S.C. 154(b) by 0 days.

(21) Appl. No.: 16/066,922

(22) PCT Filed: Dec. 5, 2017

(86) PCT No.: PCT/JP2017/043591
§ 371 (c)(1),
(2) Date: Jun. 28, 2018

(87) PCT Pub. No.: WO2019/111313
PCT Pub. Date: Jun. 13, 2019

(65) Prior Publication Data

US 2019/0357599 A1 Nov. 28, 2019

(51) Int. Cl.
*A41D 1/02* (2006.01)
*A41D 1/04* (2006.01)
(Continued)

(52) U.S. Cl.
CPC ..... *A41D 1/02* (2013.01); *A41D 1/04* (2013.01); *A41D 3/02* (2013.01); *A41D 27/24* (2013.01);
(Continued)

(58) Field of Classification Search
CPC ..... A41D 1/02; A41D 1/04; A41D 2300/32; A41D 2300/324; A41D 27/24; A41D 3/02
(Continued)

(56) References Cited

U.S. PATENT DOCUMENTS 1,421,053 A * 6/1922 Winchester ..... A41D 11/00 2/106
2,037,918 A * 4/1936 Papageorge ..... A41D 1/02 2/96
(Continued)

FOREIGN PATENT DOCUMENTS

CN 205624550 * 10/2016 ..... A41D 1/04
CN 205624550 U 10/2016
(Continued)

OTHER PUBLICATIONS

[No Author Listed] Ultra down Jacket of 2017 Which Evolved the Width and Function of Dressing. Fast Retailing Co., Ltd. http://www.uniqlo.com/jp/corp/pressrelease/2017/09/17090711_uld.html, Sep. 7, 2017, 6 pages.

*Primary Examiner* — Katherine M Moran
(74) *Attorney, Agent, or Firm* — Wolf, Greenfield & Sacks, P.C.

(57) ABSTRACT

Provided is an upper wear allowing an increase in variations of wear coordination of the upper wear. An upper wear 1 includes a front panel 10 having front panel pieces 50 and 51 at left and right. The upper wear 1 is configured such that respective upper parts of the left and right front panel pieces 50 and 51 can be folded back to the back surface sides thereof, to be held at the back surfaces of the front panel pieces 50 and 51, respectively.

5 Claims, 12 Drawing Sheets

(51) Int. Cl.
*A41D 3/02* (2006.01)
*A41D 27/24* (2006.01)

(52) U.S. Cl.
CPC .... *A41D 2300/32* (2013.01); *A41D 2300/324* (2013.01)

(58) Field of Classification Search
USPC ... 2/60, 75, 96, 80, 106, 115, 121, 129, 139, 2/265, 93
See application file for complete search history.

(56) References Cited

U.S. PATENT DOCUMENTS

| | | | | | |
|---|---|---|---|---|---|
| 2,974,320 | A * | 3/1961 | Miller | A41D 27/18 | 2/98 |
| 3,394,437 | A * | 7/1968 | Sinclair | A41F 1/00 | 24/301 |
| 3,801,985 | A * | 4/1974 | Batt | A41D 13/04 | 2/48 |
| 2012/0079645 | A1 * | 4/2012 | Carlson | A41B 13/08 | 2/265 |

FOREIGN PATENT DOCUMENTS

| | | | |
|---|---|---|---|
| DE | 202014002897 | U | 10/2014 |
| GB | 191206374 | A | 7/1912 |
| JP | S48-004648 | Y | 2/1973 |
| JP | S52-025810 | U | 2/1977 |
| JP | H04-007611 | U | 1/1992 |
| KR | 10-2008-0024500 | A | 3/2008 |
| WO | WO 02/078473 | A1 | 10/2002 |

* cited by examiner

UPPER WEAR

CROSS-REFERENCE TO RELATED APPLICATIONS

This application is a National Stage filing under 35 U.S.C. § 371 of International Application No. PCT/JP2017/043591, filed Dec. 5, 2017, the contents of which are incorporated herein by reference in its entirety.

TECHNICAL FIELD

The present invention relates to an upper wear having a front panel openable and closable to left and right.

BACKGROUND ART

The upper wear is convenient when it can be variously coordinated for wearing. For example, when a down jacket or a down vest for an outerwear can also be used as innerwear, the upper wear finds wider variations of wear coordination.

SUMMARY

Technical Problem

However, the so-called neckline around the neck of an upper wear has various shapes such as a round shape (crew neck) and a V shape (V neck). The shape of the neckline may restrict the wear coordination of the upper wear. For example, when a crew-neck down vest used as an outerwear is tried to be used as an innerwear of a coat, the down vest may be hesitated to be coordinated therewith because the neckline part of the down vest is largely seen around the neck of the coat.

The present application was completed in view of such circumstances, and it is an object thereof to provide an upper wear allowing an increase in variations of wear coordination of the upper wear.

Solution to Problem

An upper wear in accordance with one aspect of the present invention includes a front panel having front panel pieces at left and right, and is configured such that upper parts of the respective left and right front panel pieces folded back to the back surface sides of the front panel pieces can be held on the back surface sides, respectively.

In accordance with the present aspect, respective upper parts of the left and right front panel pieces can be inwardly folded back to be held at the back surfaces of respective front panel pieces, respectively. For this reason, if required, the shape of the neckline of the upper wear can be changed. This can increase the variations in wear coordination of the upper wear.

The upper wear may include: an interlocked member provided at the upper part of each of the front panel pieces; and an interlocking member provided at the back surface of each of the front panel pieces, and for interlocking with the interlocked member. In accordance with such an aspect, respective upper parts of the front panel pieces can be preferably locked to respective back surfaces of the front panel pieces, respectively.

It is also acceptable that a string-like member is attached to the back surface of each of the front panel pieces, and the interlocking member is attached to the string-like member.

In accordance with such an aspect, the interlocking member can move by the string-like member. This can suppress, for example, wrinkling of the front panel due to stiffening of the folded-back portion of the upper part of each front panel piece.

It is also acceptable that the string-like member is located to face, in a longitudinal direction, obliquely upward to an upper part side of the front panel piece, and has a lower end fixed to the back surface of the front panel piece, and also has an upper end attached with the interlocking member.

The upper wear may further include an engaging mechanism making the left and right front panel pieces engageable with each other. It is also acceptable that a member of the engaging mechanism situated at the upper part of the front panel piece is used for the interlocked member.

It is also acceptable that the engaging mechanism is a snap button, the interlocked member is either a male snap or a female snap of the snap button situated at the upper part of each of the front panel pieces, and the interlocking member is either a female snap or a male snap of a snap button capable of interlocking with the male snap or the female snap of the snap button at the upper part of the front panel piece.

It is also acceptable that the back surface of each of the front panel pieces is provided with a pocket for insertion and holding of the upper part of each of the front panel pieces therein.

The upper wear may be configured such that the upper part of each of the front panel pieces is held at the back surface of each of the front panel pieces, thereby rendering a neckline of the front panel into a V shape.

The upper wear may be a down jacket, a down vest, or a down coat.

Advantageous Effects of Invention

The present invention can provide an upper wear allowing an increase in variations of wear coordination of the upper wear.

DESCRIPTION OF EMBODIMENTS

Figure 1:
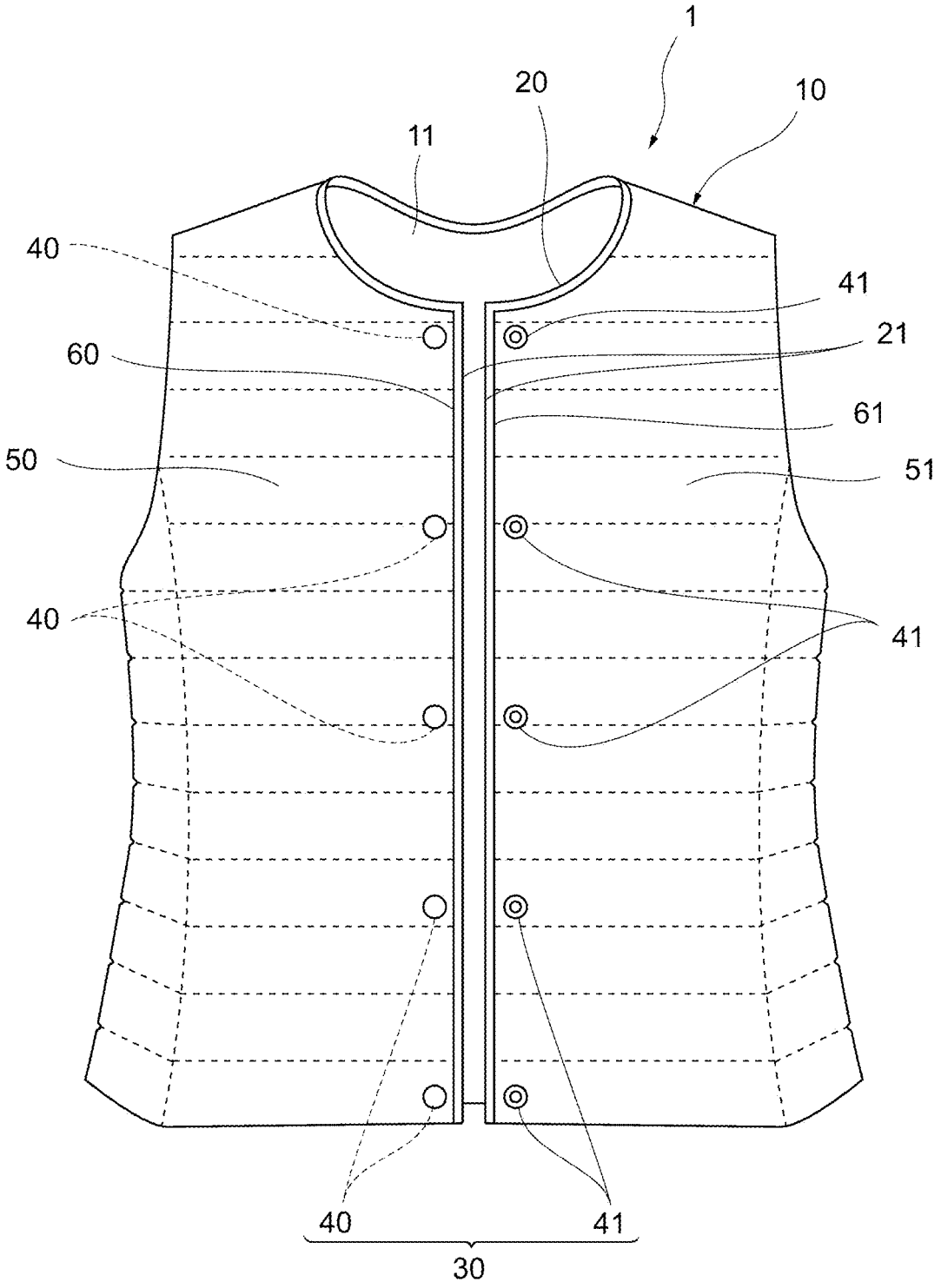
FIG. 1 is a front view of an upper wear.

Below, preferred embodiments of the present invention will be described by reference to the accompanying drawings. Incidentally, the same elements are given the same reference number and sign, and an overlapping description thereof is omitted. Further, the vertical and horizontal positional relationship, and other positional relationships are assumed to be based on the positional relationships shown in the drawings unless otherwise specified. Further, the dimensional ratio of the drawing is not limited to the ratio shown in the drawing. Further, the following embodiments are examples for describing the present invention, and the present invention is not limited to the embodiments.

FIG. 1 is a front view showing one example of an upper wear 1 in accordance with the present embodiment. The upper wear 1 is, for example, a down vest, and has a front panel 10 openable/closable to left and right and a back panel 11. The upper wear 1 has, for example, a collarless circular (crew-necked) neckline 20. The front panel 10 is divided into left and right at the center of the front surface by a dividing line 21 vertically extending from the center of the neckline 20 to the lower end of the front panel 10. The front panel 10 includes snap buttons 30 as engaging mechanisms for putting the left and right front panel pieces 50 and 51 into engagement with each other. A plurality of snap buttons 30 are vertically arranged.

Figure 2:
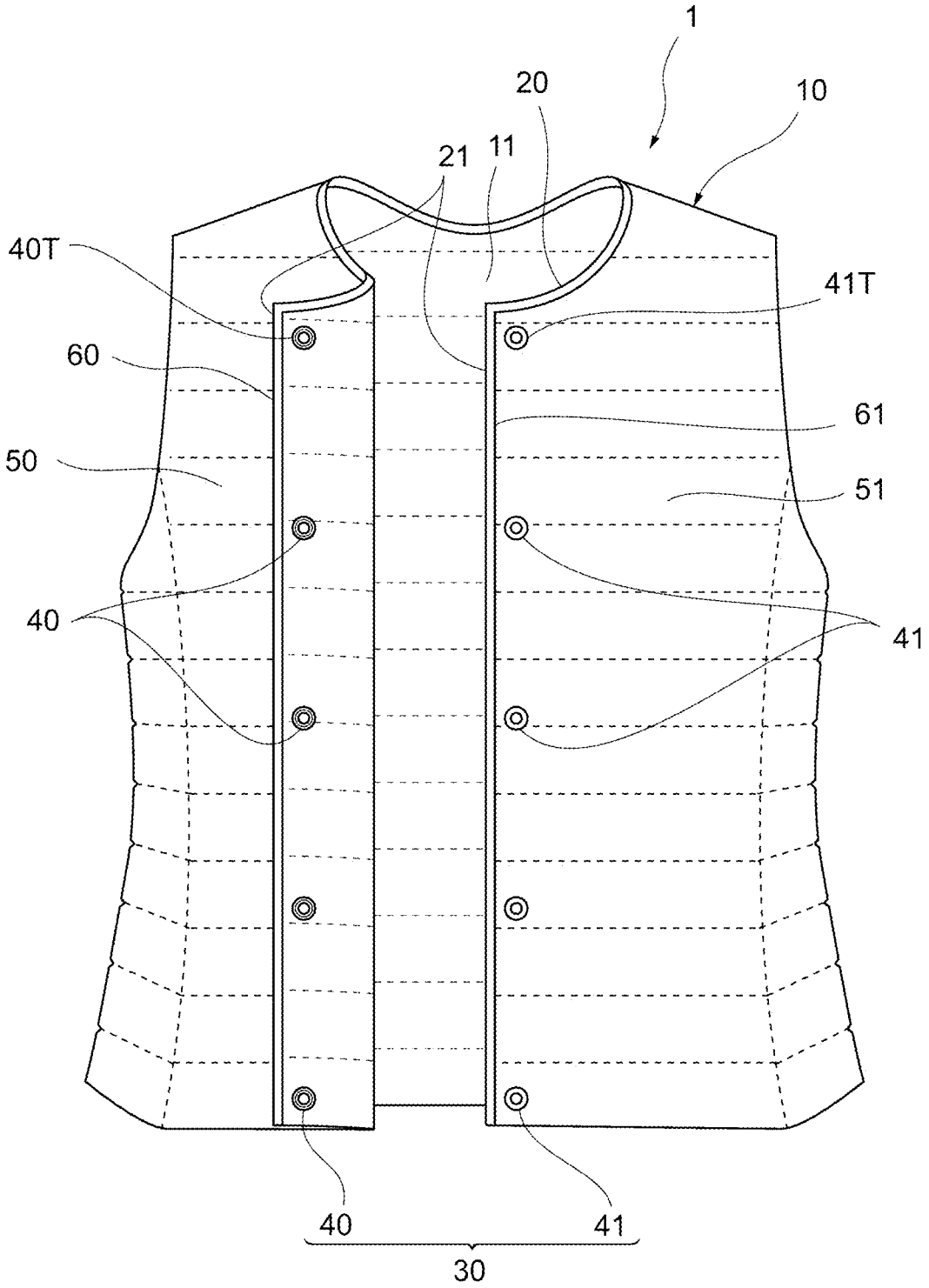
FIG. 2 is an explanatory view showing snap buttons of the upper wear.

Each snap button 30 includes a pair of concave female snap 40 and convex male snap 41 engageable with and disengageable from each other as shown in FIG. 2. At the back surface of one front pane piece (right front panel piece as seen from a wearer) 50, the female snap 40 is located. The male snap 41 is located at the front surface of the other front panel piece (left front panel piece as seen from a wearer) 51. The female snaps 40 are arranged vertically along the side edge 60 on the dividing line 21 side (center side) of the back surface of the front panel piece 50. The male snaps 41 are arranged vertically along the side edge 61 on the center side of the front surface of the front panel piece 51. The side edge 60 of the front panel piece 50 is superposed on the side edge 61 of the front panel piece 51, and the female snaps 40 and the male snaps 41 are locked to each other, respectively. As a result, the center of the front surface of the front panel 10 can be closed. Incidentally, the uppermost female snap 40 (40T) of the plurality of female snaps 40, and the uppermost male snap 41 (41T) of the plurality of male snaps 41 are located in the vicinity of the point of intersection of the neckline 20 and the dividing line 21, and form an interlocked member to be locked to an interlocking member described later.

Figure 3:
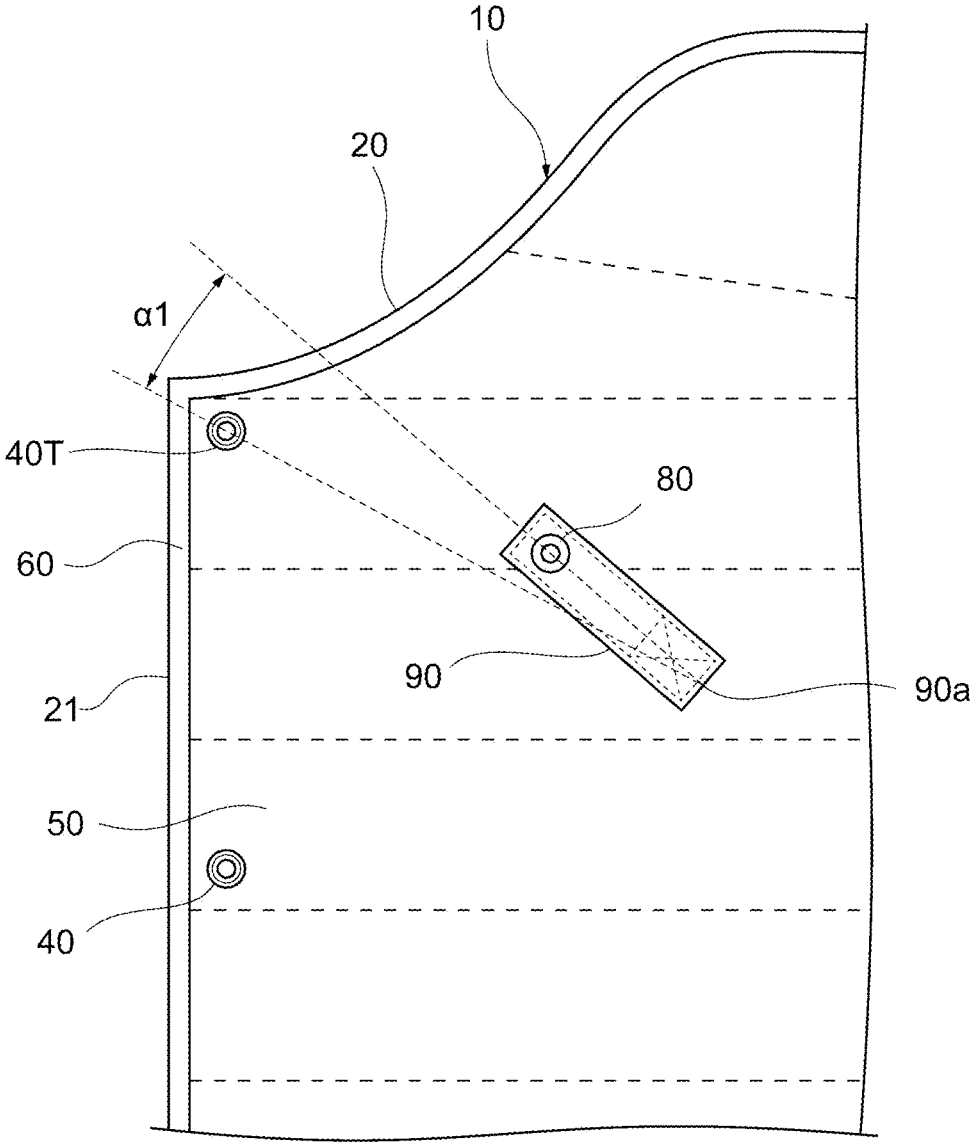
FIG. 3 is an explanatory view showing the back surface of a right front panel piece.

As shown in FIG. 3, a male snap 80 of a snap button as an interlocking member capable of locking the uppermost female snap 40T is provided at the back surface of the front panel piece 50. A string-like member (tag) 90 for fixing the male snap 80 is attached to the back surface of the front panel piece 50. The string-like member 90 is, for example, formed of the same material as that for the fabric of the front panel piece 50, and has an elongated rectangular shape. The string-like member 90 is sewn at its one end 90*a* to the back surface of the front panel piece 50, and is attached with the male snap 80 at the other end thereof. The male snap 80 is attached to the front surface side (the front surface side of the string-like member 90 when the front panel piece 50 is seen from the back surface side) of the string-like member 90.

The string-like member 90 is located to face, in the longitudinal direction, obliquely upward to the upper part side of the front panel piece 50. The string-like member 90 is fixed at the position lower than the uppermost female snap 40T, and extends therefrom obliquely in an upward direction to the female snap 40T side. The string-like member 90 is, for example, allowed to face toward the position slightly higher than the uppermost female snap 40T. Namely, with respect to an imaginary line L1 passing through the fixed one end 90*a* (lower end) of the string-like member 90 and the uppermost female snap 40T, an imaginary line L2 passing through the fixed one end 90*a* and the other end including the male snap 80 present thereat is shifted upward by about 3° to 45° (an angle $\alpha$1 shown in FIG. 3).

Figure 4:
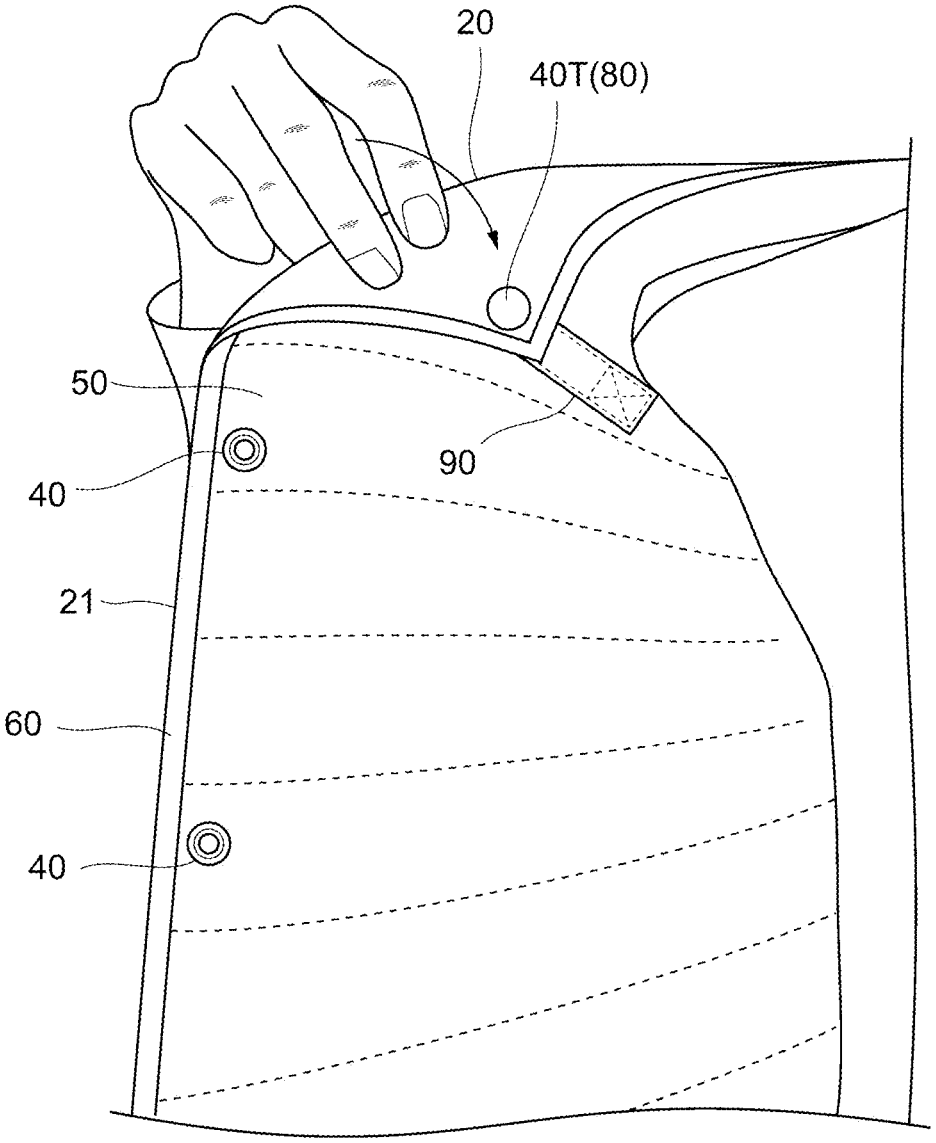
FIG. 4 is an explanatory view showing the back surface of the right front panel piece with the upper part of the right front panel piece fixed at the back surface.
Figure 5:
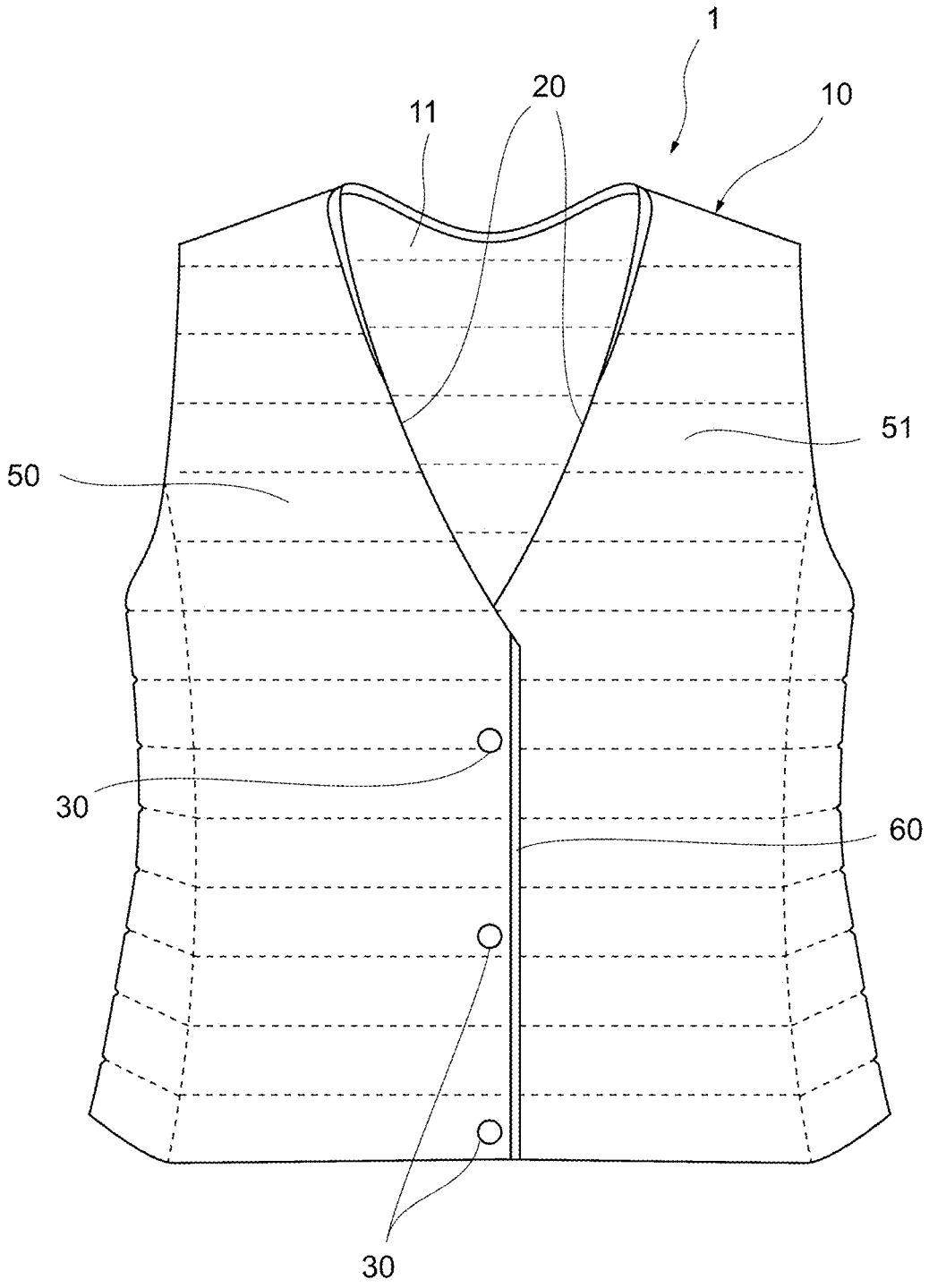
FIG. 5 is a front view of the upper wear with the neckline in a V shape.

As shown in FIG. 4, the upper part of the front panel piece 50 is folded inwardly, so that the uppermost female snap 40T is locked to the male snap 80. As a result, as shown in FIG. 5, the neckline 20 of the front panel piece 50 becomes a part of a V neck.

Figure 6:
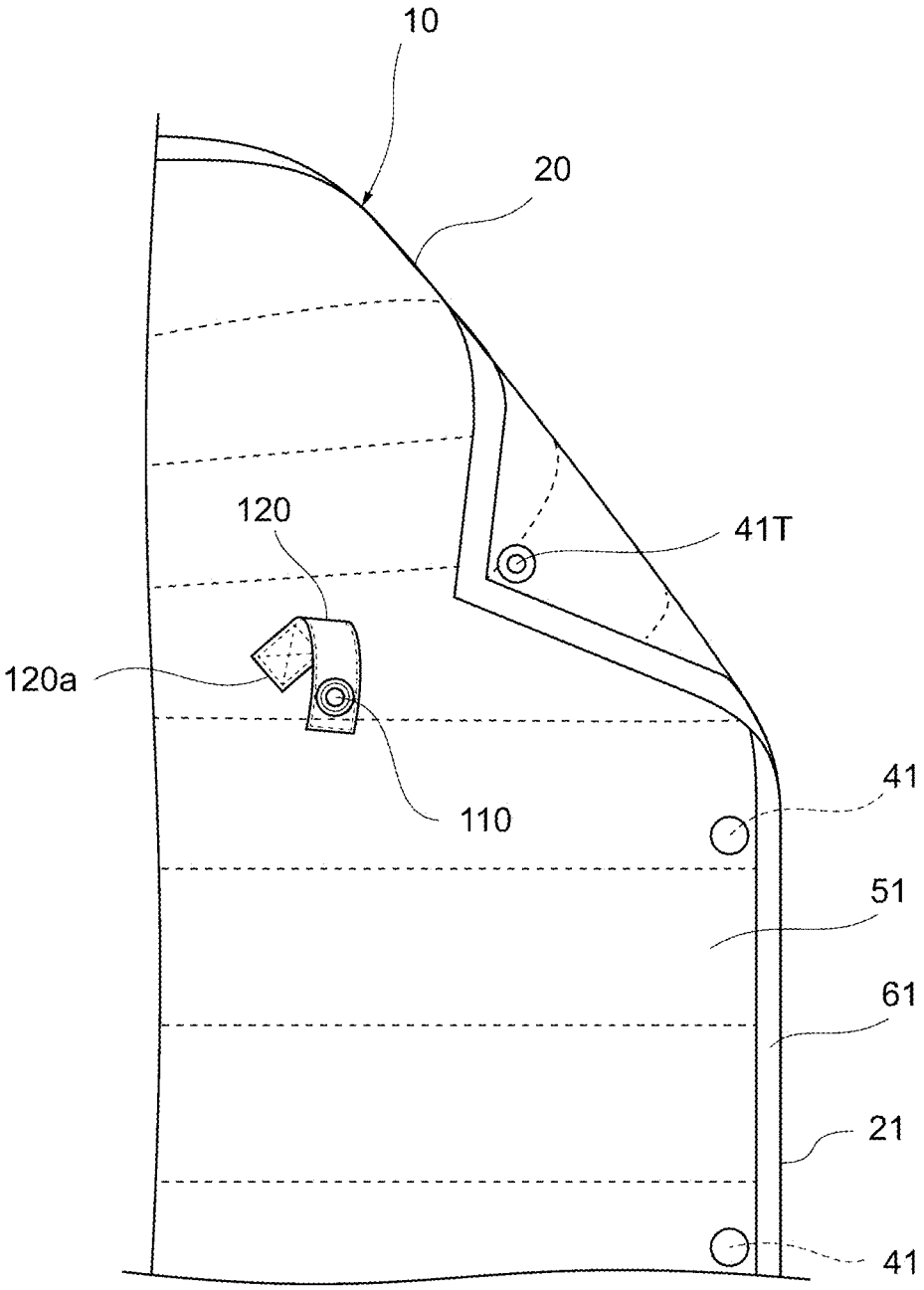
FIG. 6 is an explanatory view showing the back surface of a left front panel piece.

As shown in FIG. 6, a female snap 110 of a snap button as an interlocking member capable of locking the uppermost male snap 41T is provided at the back surface of the front panel piece 51. A string-like member 120 for fixing the female snap 110 is provided at the back surface of the front panel piece 51. The string-like member 120 is formed of, for example, the same material as that for the fabric of the front panel piece 51, and has an elongated rectangular shape. The string-like member 120 is sewn at its one end 120*a* to the back surface of the front panel piece 51, and the female snap 110 is attached to the other end thereof. The female snap 110 is attached to the back surface side (the back surface side of the string-like member 120 when the front panel piece 51 is seen from the back surface side) of the string-like member 120.

Figure 7:
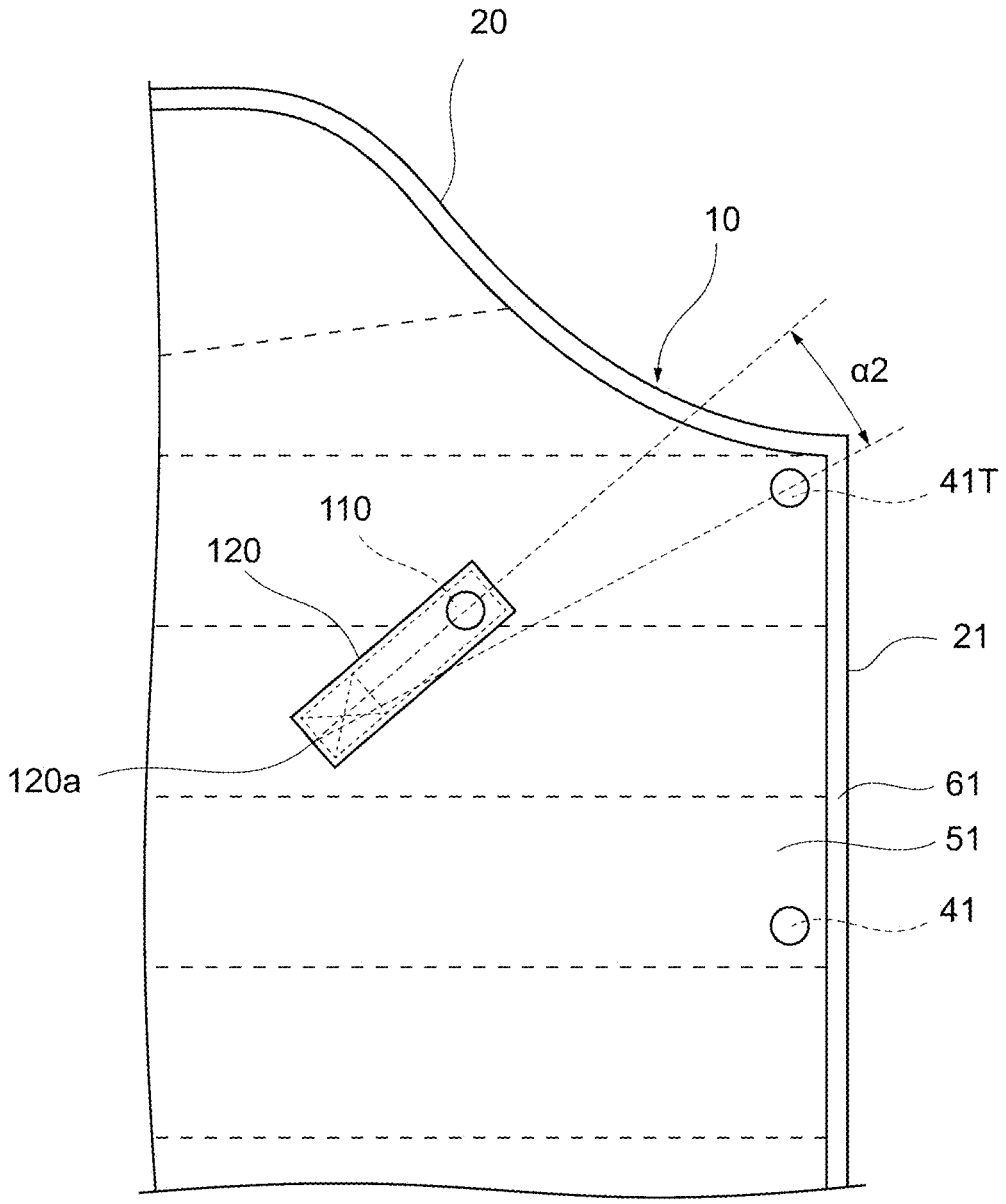
FIG. 7 is an explanatory view showing the back surface of the left front panel piece.

As shown in FIG. 7, the string-like member 120 is located so that the longitudinal direction faces obliquely upward of the upper part side of the front panel piece 51. The string-like member 120 is fixed at the position lower than the uppermost male snap 41T, and extends therefrom in the obliquely upward direction of the male snap 41T side. The string-like member 120 is, for example, allowed to face toward the position slightly higher than the uppermost male snap 41T. Namely, with respect to an imaginary line L3 passing through the fixed one end 120*a* (lower end) of the string-like member 120 and the uppermost male snap 41T, an imaginary line L4 passing through the fixed one end 120*a* and the other end including the female snap 110 present thereat is shifted upward by about 3° to 45° (an angle $\alpha$2 shown in FIG. 7).

Figure 8:
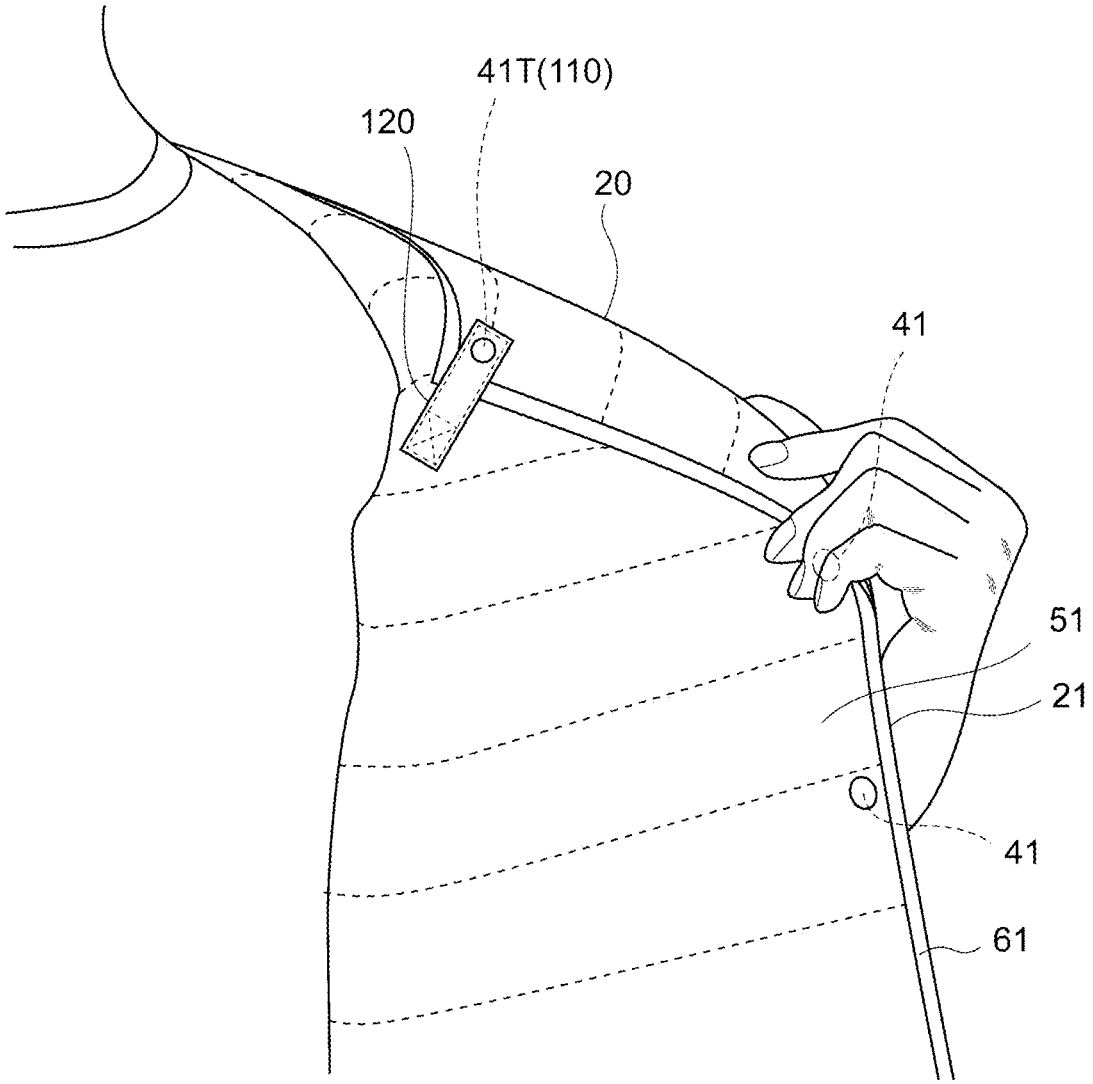
FIG. 8 is an explanatory view showing the back surface of the left front panel piece with the upper part of the left front panel piece fixed at the back surface.

As shown in FIG. 8, the upper part of the front panel piece 51 is folded inwardly, so that the uppermost male snap 41T is locked to the female snap 110. As a result, as shown in FIG. 5, the neckline 20 of the front panel piece 51 becomes a part of a V neck.

The upper wear 1 may be manufactured, for example, by the following procedure so as to prevent the seams of the string-like members 90 and 120 from appearing at the outer fabrics of the front panel pieces 50 and 51. First, the outer fabrics and the lining fabrics of the front panel pieces 50 and 51, and the string-like members 90 and 120 are formed, respectively. Then, the string-like members 90 and 120 are sewn to the lining fabrics. Then, the outer fabrics and the lining fabrics are sewn into the shapes of the front panel pieces 50 and 51. Then, feathers are put therein. With the present method, the seams are not seen from the outer side of the front panel pieces 50 and 51, resulting in a beautiful external appearance. Further, the amount of the seams is suppressed to the requisite minimum, which can prevent the feathers from coming out.

Figure 9:
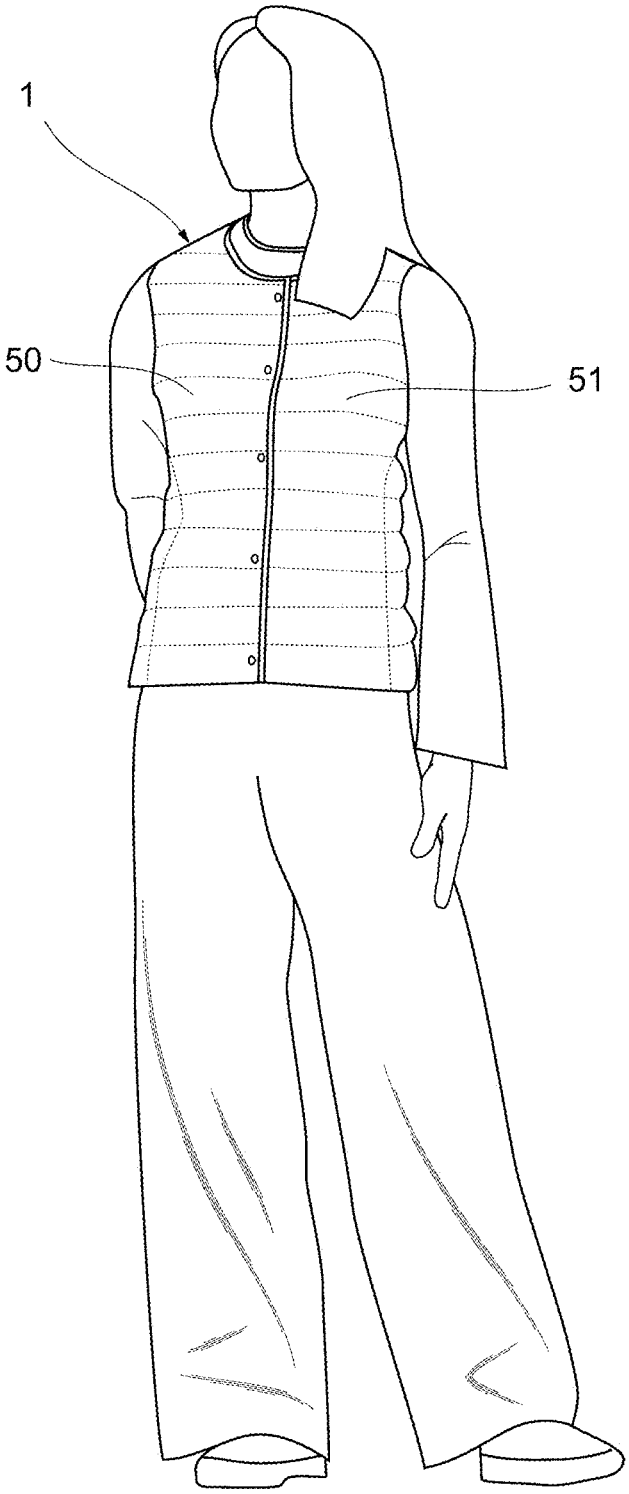
FIG. 9 is a view showing one example using the upper wear as an outerwear.
Figure 10:
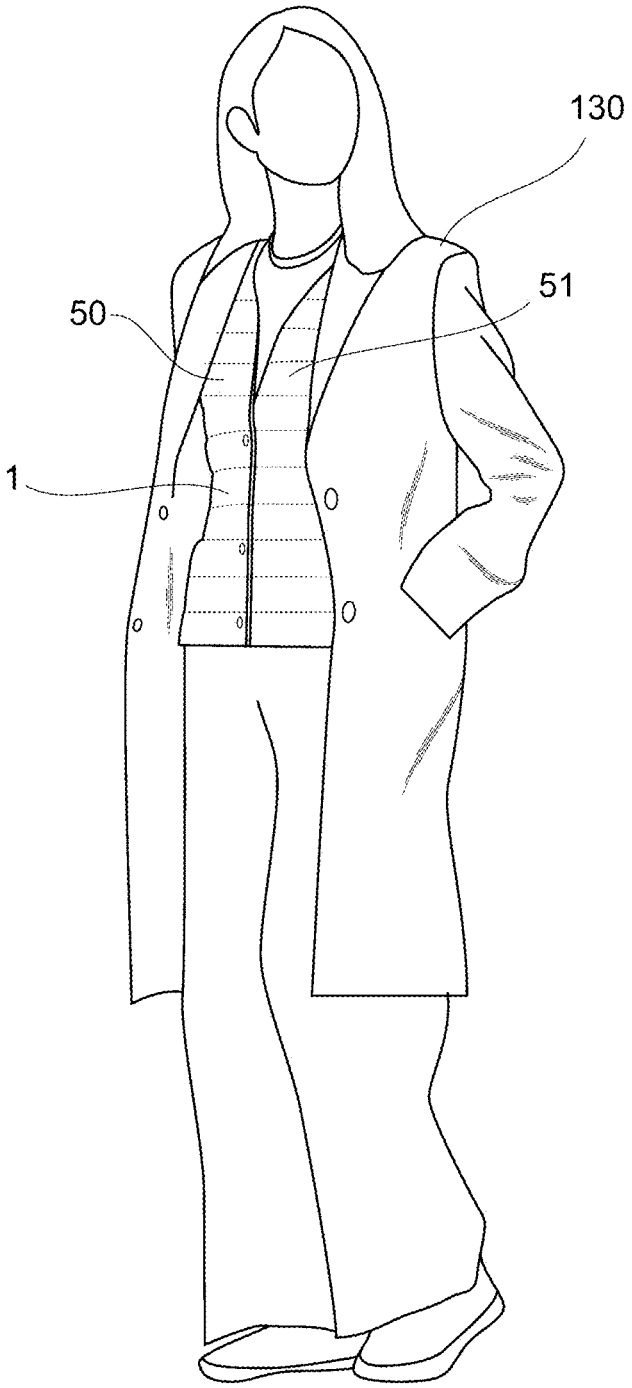
FIG. 10 is a view showing one example using the upper wear as an innerwear.

Then, one example of wear coordination of the upper wear 1 will be described. For example, as shown in FIG. 9, the upper wear 1 is used as an outerwear. At this step, for example, when the female snaps 40 and the male snaps 41 of the snap buttons 30 of the front panel pieces 50 and 51 are locked with each other, respectively, the neckline 20 is in the shape of a crew neck. Then, for example, as shown in FIG. 10, the upper wear 1 is used as an innerwear of a coat 130. At this step, the upper part of the front panel piece 50 is folded back inwardly, and the uppermost female snap 40T of the front panel piece 50 is locked to the male snap 80 at the back surface of the front panel piece 50 (shown in FIG. 4). Whereas, the upper part of the front panel piece 51 is folded back inwardly, and the uppermost male snap 41T of the front panel piece 51 is locked to the female snap 110 at the back surface of the front panel piece 51 (shown in FIG. 8). The residual female snaps 40 and male snaps 41 of the snap buttons 30 are locked with each other, respectively. As a result, the neckline 20 of the upper wear 1 is in the shape of a V neck. This eliminates a sense of incongruity even when the upper wear 1 is used as an innerwear of the coat 130 such as a Chester coat with a large neckline. Further, when the front opening of the coat 130 is closed, the upper wear 1 is prevented from being exposed from the neck of the coat 130.

In accordance with the present embodiment, the upper wear 1 is configured such that respective upper parts of the left and right front panel pieces 50 and 51 can be folded back inwardly to be held at respective back surfaces of the front panel pieces 50 and 51, respectively. For this reason, the upper wear 1 can be used in a so-called 2 WAY in which the shape of the neckline 20 of the upper wear 1 is varied between, for example, a crew neck and a V neck, if required. As a result, the variations of wear coordination of the upper wear 1 can be increased.

The upper wear 1 includes the female snap 40 and the male snap 41 of the snap button 30 provided at the upper part of respective front panel pieces 50 and 51, and the male snap 80 and the female snap 110 of the snap button provided at the back surfaces of respective front panel pieces 50 and 51. The female snap 40 can be locked to the male snap 80, and the male snap 41 can be locked to the female snap 110. As a result, respective upper parts of the front panel pieces 50 and 51 can be preferably locked to respective back surfaces of the front panel pieces 50 and 51, respectively.

The string-like members 90 and 120 are attached to respective back surfaces of the front panel pieces 50 and 51, respectively. The male snap 80 of the snap button is attached to the string-like member 90, and the female snap 110 of the snap button is attached to the string-like member 120. In accordance with such an aspect, the male snap 80 and the female snap 110 can move. This can suppress, for example, wrinkling of the front panel 10 due to stiffening of the folded-back portions of respective upper parts of the front panel pieces 50 and 51. Further, the operation of locking the upper parts of the front panel pieces 50 and 51 to respective back surfaces can be performed with ease even while the upper wear 1 is being worn.

The string-like members 90 and 120 are located so that the longitudinal direction faces obliquely upward of the upper part side of the front panel pieces 50 and 51, respectively. The lower ends 90*a* and 120*a* are fixed to the back surfaces of the front panel pieces 50 and 51, respectively. The male snap 80 and the female snap 110 are attached to the upper ends, respectively. As a result, the operation of locking the upper parts of the front panel pieces 50 and 51 to respective back surfaces can be performed with more ease even while the upper wear 1 is being worn.

The upper wear 1 has snap buttons 30 for making the left and right front panel pieces 50 and 51 engageable with each other, and locks the front panel pieces 50 and 51 at their respective back surfaces using the female snap 40T and the male snap 41T of the snap button 30 situated at the upper parts of the front panel pieces 50 and 51, respectively. This eliminates the necessity of providing buttons exclusively for locking the upper parts of the front panel pieces 50 and 51.

The uppermost female snap 40T of the snap buttons 30 of the front panel piece 50 can be locked to the male snap 80 at the back surface thereof, and the uppermost male snap 41T of the snap buttons 30 of the front panel piece 51 can be locked to the female snap 110 at the back surface thereof. As a result, respective upper parts of the front panel pieces 50 and 51 can be locked to respective back surfaces of the front panel pieces 50 and 51, respectively.

The upper wear 1 is configured such that respective upper parts of the front panel pieces 50 and 51 are locked to respective back surfaces of the front panel pieces 50 and 51, resulting in a V-shaped neckline 20 of the front panel 10. This can suppress the neckline 20 of the upper wear 1 from being exposed from the neck of an outerwear when the upper wear 1 is used as an innerwear.

The upper wear 1 is a down vest, and hence the down vest becomes more likely to be used as an innerwear. Accordingly, a proper precaution against the cold can be taken.

Up to this point, the preferred embodiments of the present invention were described by reference to the accompanying drawings. However, the present invention is not limited to such examples. It is apparent that those skilled in the art can achieve various changed examples or modified examples within the scope of the concept described in the claims, and it is naturally understood that these belong to the technical scope of the present invention.

Figure 11:
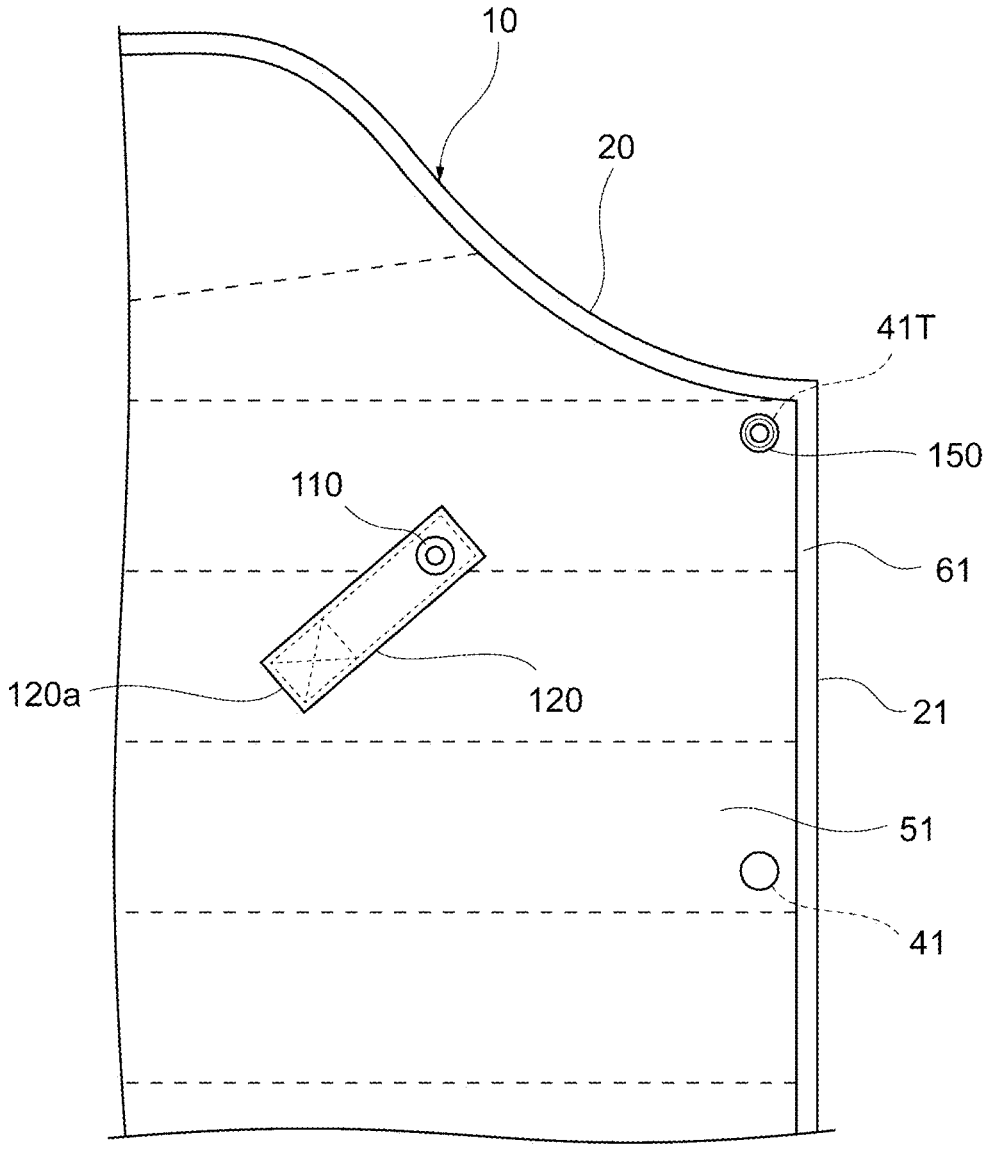
FIG. 11 is an explanatory view showing the back surface of the left front panel piece when a male snap or a female snap is provided at the back surface of the upper part of the left front panel piece.

For example, in the embodiment, the following is also acceptable: as shown in FIG. 11, to the back surface of the upper part of the front panel piece 51, namely, the back surface of the uppermost male snap 41T, a male snap 150 or a female snap 150 of a snap button is attached; and to the string-like member 120, a female snap 110 or a male snap 110 for locking it is attached. In such a case, as with the front panel piece 50, the upper part of the front panel piece 51 can be folded back to the back surface side, thereby to lock the male snap 150 or the female snap 150 at the back surface of the front panel piece 51 to the female snap 110 or the male snap 110 of the string-like member 120. For this reason, the upper part of the front panel piece 51 can be locked with more ease.

Further, the interlocking member and the interlocked member were snap buttons, but, not limited thereto, may be a button and a button hole, a hook and loop fastener, or the like so long as they are engageable with or disengageable from each other. Similarly, the engaging mechanisms for mutually engaging the front panel pieces 50 and 51 were the snap buttons 30, but may be buttons and button holes, a hook and loop fastener, a zip fastener, or the like. The number of the interlocking members and the interlocked members was one for each of the front panel pieces 50 and 51, but may be a plural number for each. Further, the positions of the interlocking member and the interlocked member may be appropriately changed according to the size of the upper wear 1, and the like. The button of the interlocking member may be set as that of a rotary type, which enables a change in angle (depth of the V shape) of the V-shaped neckline. The string-like member was fixed by sewing to the front panel piece, but may be fixed by bonding, a magnet, a hook and loose fastener, or the like.

Figure 12:
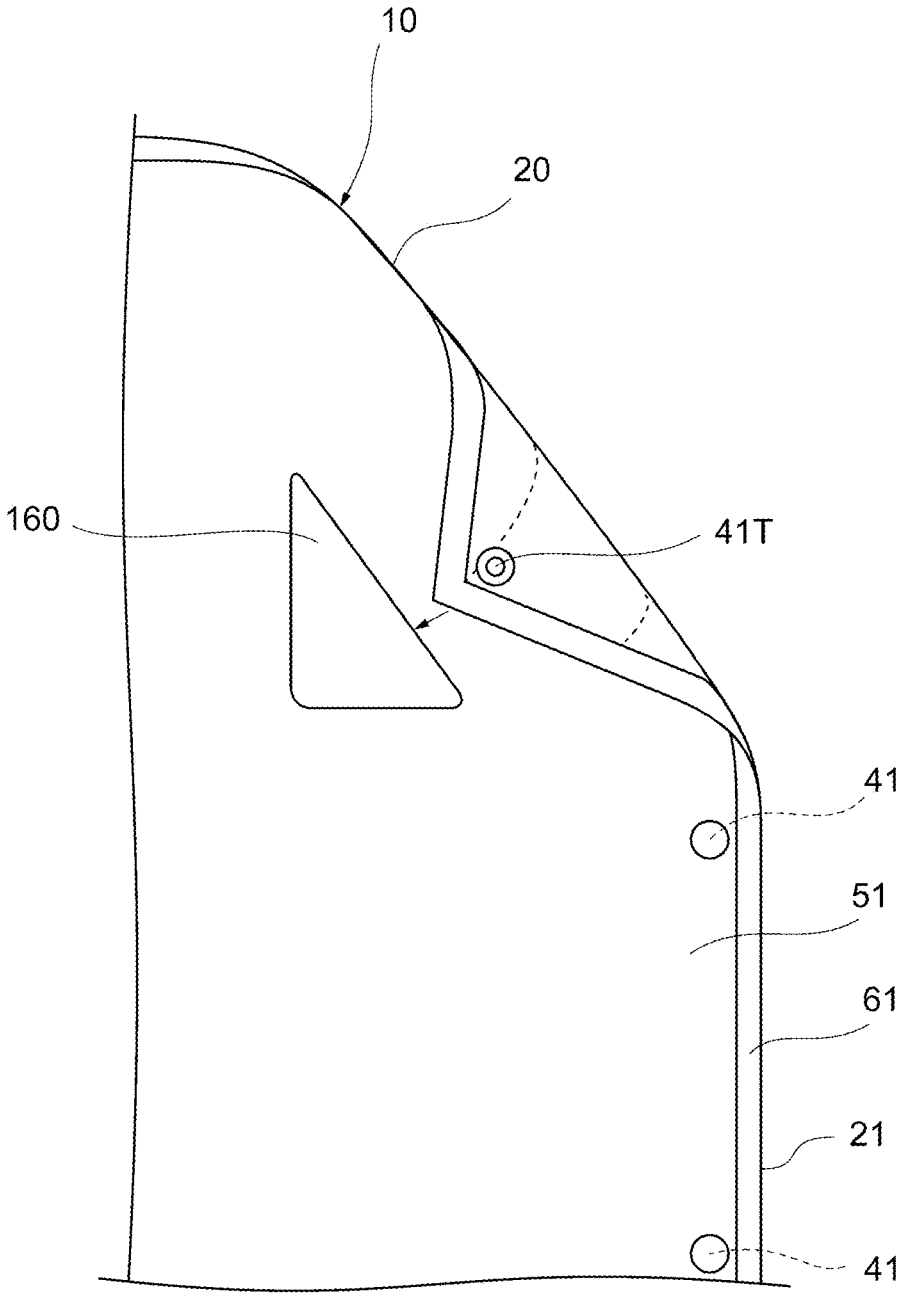
FIG. 12 is an explanatory view showing the back surface of the left front panel piece when a pocket is provided at the back surface of the front panel piece.

The configuration for holding respective upper parts of the front panel pieces 50 and 51 folded back to the back surface sides are not limited to the interlocking member and the interlocked member, and may be other configurations. For example, the following configuration is also acceptable: a pocket is provided at each back surface of respective front panel pieces 50 and 51, so that each upper part of the front panel pieces 50 and 51 is inserted and held in the pocket. For example, as shown in FIG. 12, a lining fabric is further added to the back surface of the front panel piece 51, and the lining fabric is provided with a pocket 160 opening toward the upper part side of the front panel piece 51. The pocket 160 is, for example, sewn to the back surface of the front panel piece 51. The same pocket 160 is also attached to the front panel piece 50. In such a case, the upper parts of the front panel pieces 50 and 51 are not required to be locked by a button or the like, and can be readily held in a folded-back state.

Further, other than these, the following configuration is also acceptable: each upper part of the front panel pieces 50 and 51 is allowed to include a wire such as a resin wire for storing the shape; and each upper part of the front panel pieces 50 and 51 is folded back to the back surface side, and is held in the state.

In the embodiments up to this point, the initial neckline of the upper wear 1 was in the shape of a crew neck, and the neckline after folding back and locking respective front panel pieces 50 and 51 was in a V shape. However, the shape of the neckline is not limited thereto. The upper wear 1 was a down vest, but is not limited thereto. The present invention is also applicable to other upper wears 1 such as a down jacket, a cardigan, and an underwear.

INDUSTRIAL APPLICABILITY

The present invention is useful for providing an upper wear allowing an increase in variations of wear coordination of the upper wear.

REFERENCE SIGNS LIST

1 Upper wear
10 Front panel
20 Neckline
50, 51 Front panel piece
30 Snap button
40 Female snap
40T Uppermost female snap
41 Male snap
41T Uppermost male snap
90 String-like member
80 Male snap
110 Female snap
120 String-like member

What is claimed is:

1. An upper wear comprising:

a front panel having first and second front panel pieces at left and right, respectively;

an interlocked member provided at an upper part of each of the first and second front panel pieces; and an interlocking member provided at a back surface of each of the first and second front panel pieces, the interlocking member configured to interlock with the interlocked member;

wherein the upper part of each of the first and second front panel pieces is arranged to be folded inwardly to the back surface of the respective first and second front panel pieces such that the upper part can be held on the back surface by the interlocked member and the interlocking member; and wherein a tag is attached to the back surface of each of the first and second front panel pieces, and the interlocking member is attached to the tag.

2. The upper wear according to claim 1, wherein the tag is located to face, in a longitudinal direction, obliquely upward to an upper part side of the front panel piece, and has a lower end fixed to the back surface of the front panel piece, and also has an upper end attached with the interlocking member.

3. The upper wear according to claim 1, wherein the upper part of each of the first and second front panel pieces is configured to be held at the back surface of each of the respective first and second front panel pieces, thereby rendering a neckline of the front panel into a V shape.

4. The upper wear according to claim 1, wherein the upper wear is a down jacket, a down vest, or a down coat.

5. The upper wear according to claim 1, wherein the interlocked member is provided on the upper part of each of the first and second front panel pieces, and wherein the interlocking member is provided on the back surface of each of the first and second front panel pieces.

* * * * *